US011686528B2

(12) United States Patent
Turner et al.

(10) Patent No.: US 11,686,528 B2
(45) Date of Patent: Jun. 27, 2023

(54) SINGLE COLUMN NITROGEN REJECTION UNIT WITH SIDE DRAW HEAT PUMP REFLUX SYSTEM AND METHOD

(71) Applicant: Chart Energy & Chemicals, Inc., Ball Ground, GA (US)

(72) Inventors: Peter J. Turner, The Woodlands, TX (US); Douglas A. Ducote, Jr., The Woodlands, TX (US); Timothy P. Gushanas, Pearland, TX (US)

(73) Assignee: Chart Energy & Chemicals, Inc., Ball Ground, GA (US)

( * ) Notice: Subject to any disclaimer, the term of this patent is extended or adjusted under 35 U.S.C. 154(b) by 352 days.

(21) Appl. No.: 16/837,039

(22) Filed: Apr. 1, 2020

(65) Prior Publication Data

US 2020/0340740 A1 Oct. 29, 2020

Related U.S. Application Data

(60) Provisional application No. 62/837,439, filed on Apr. 23, 2019.

(51) Int. Cl.
*F25J 3/02* (2006.01)

(52) U.S. Cl.
CPC ..... *F25J 3/0257* (2013.01); *F25J 3/0209* (2013.01); *F25J 2200/02* (2013.01);
(Continued)

(58) Field of Classification Search
CPC ..... F25J 3/0257; F25J 3/029; F25J 1/0022; F25J 2205/02; F25J 3/0209; F25J 3/0233;
(Continued)

(56) References Cited

U.S. PATENT DOCUMENTS 3,797,261 A 3/1974 Juncker et al.
3,813,890 A 6/1974 Bligh
(Continued)

FOREIGN PATENT DOCUMENTS

DE 2131341 A1 12/1972
EP 0725256 A1 8/1996
(Continued)

OTHER PUBLICATIONS

International Search Report and Written Opinion for International Application No. PCT/US2020/028093, dated Jul. 13, 2020. (16 pages total).
(Continued)

*Primary Examiner* — Frantz F Jules
*Assistant Examiner* — Webeshet Mengesha
(74) *Attorney, Agent, or Firm* — Cook Alex Ltd.

(57) ABSTRACT

A system for removing nitrogen from a natural gas fluid feed stream includes a main heat exchanger that receives the natural gas fluid feed stream. A distillation column receives a cooled fluid stream from the main heat exchanger and features a return vapor outlet and a side vapor outlet port. The return vapor outlet provides nitrogen vapor to the main heat exchanger which is warmed therein. The side vapor outlet port provides vapor to the main heat exchanger and a reflux compressor receives and compresses the resulting fluid from the main heat exchanger. A reflux aftercooler receives and cools fluid from the reflux compressor, directs cooled fluid to the main heat exchanger and the resulting fluid is directed to a reflux separation device. The reflux separation device has a vapor outlet and a liquid outlet. The vapor outlet of the reflux separation device directs fluid to the main heat exchanger so that fluid is directed to the first reflux inlet port of the distillation column. The liquid outlet
(Continued)

of the reflux separation device directs fluid to a second reflux inlet port of the distillation column.

15 Claims, 5 Drawing Sheets

(52) U.S. Cl.
CPC ..... *F25J 2200/50* (2013.01); *F25J 2200/72* (2013.01); *F25J 2205/04* (2013.01); *F25J 2270/12* (2013.01)

(58) Field of Classification Search
CPC .. F25J 2200/72; F25J 2270/02; F25J 2270/88; F25J 2200/78; F25J 2205/04
See application file for complete search history.

(56) References Cited

U.S. PATENT DOCUMENTS 4,203,741 A * 5/1980 Bellinger ..... C07C 7/005 62/621
4,225,329 A 9/1980 Bailey et al.
4,230,469 A 10/1980 Grimm et al.
4,411,677 A 10/1983 Pervier et al.
4,415,345 A 11/1983 Swallow
4,501,600 A 2/1985 Pahade
4,504,295 A 3/1985 Davis et al.
4,496,382 A 6/1985 Geist et al.
4,592,767 A 6/1986 Pahade et al.
4,662,919 A 5/1987 Davis
4,732,598 A 3/1988 Rowles et al.
5,325,674 A 7/1994 Gatinne et al.
6,070,430 A 6/2000 McNeil et al.
6,609,393 B2 8/2003 Oakey
6,837,071 B2 1/2005 Oakey
6,978,638 B2 12/2005 Brostow et al.
7,127,915 B2 10/2006 Clare et al.
8,435,403 B2 5/2013 Sapper et al.
8,715,390 B2 5/2014 Schmidt et al.
8,794,031 B2 8/2014 Bauer et al.
9,003,829 B2 4/2015 Bauer et al.
9,335,091 B2 5/2016 Qualls et al.
2002/0095062 A1 7/2002 Paradowski
2008/0196584 A1* 8/2008 Ha ..... F25J 3/04533 95/87
2010/0175424 A1 7/2010 Walther
2011/0289963 A1 12/2011 Price
2015/0052938 A1* 2/2015 Bauer ..... F25J 3/0233 62/612
2015/0308738 A1 10/2015 Ott et al.
2016/0054054 A1 2/2016 Johnson et al.
2018/0051215 A1 2/2018 Bauer et al.

FOREIGN PATENT DOCUMENTS

GB 1539604 * 1/1979
GB 1539604 A 1/1979

OTHER PUBLICATIONS

Handley, James Richard and Webb C. Miller. "Process Requirements and Enhanced Economics of Helium Recovery From Natural Gas." SPE Mid Continent Gas Symposium, No. SPE24292 Apr. 12, 1992. (11 pages total).

* cited by examiner

SINGLE COLUMN NITROGEN REJECTION UNIT WITH SIDE DRAW HEAT PUMP REFLUX SYSTEM AND METHOD

CLAIM OF PRIORITY

This application claims the benefit of U.S. Provisional Application No. 62/837,439, filed Apr. 23, 2019, the contents of which are hereby incorporated by reference.

FIELD OF THE DISCLOSURE

The present invention relates generally to systems and methods for removing nitrogen from a natural gas or liquid natural gas stream and, more particularly, to a system and method for removing nitrogen from a natural gas or liquid natural gas stream that uses a heat pump system to provide additional refrigeration.

BACKGROUND

During, prior to or after natural gas liquefaction processes, it is often necessary to remove nitrogen from a feed stream of natural gas or liquid natural gas. This may be done due to purification or nitrogen recovery requirements. The nitrogen removed from the feed stream may be used as fuel or in other applications or vented to atmosphere. Use of a nitrogen rejection unit (NRU) for such processing of natural gas or liquid natural gas feed streams is known in the art, but increases in efficiency and reduced power requirements are desirable.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto In one aspect, a system for removing nitrogen from a natural gas fluid feed stream includes a main heat exchanger including a main feed cooling passage, a withdrawn vapor warming passage, main reflux stream cooling passage, a reflux vapor cooling passage and a nitrogen vapor return passage with the main feed cooling passage including an inlet and an outlet, where the inlet of the main feed cooling passage is configured to receive the natural gas fluid feed stream. A distillation column includes a feed inlet, a return vapor outlet, a side vapor outlet port, first and second reflux inlet ports and a bottoms liquid outlet, wherein the side vapor outlet port and the first and second reflux inlet ports are positioned between the feed inlet and the return vapor outlet. The feed inlet of the distillation column is configured to receive a fluid stream from the outlet of the main feed cooling passage of the main heat exchanger. The side vapor outlet port of the distillation column is configured to provide vapor to the withdrawn vapor warming passage of the main heat exchanger. The return vapor outlet of the distillation column is configured to provide nitrogen vapor to said nitrogen vapor return passage of the main heat exchanger. The first reflux inlet port of the distillation column is in fluid communication with the reflux vapor cooling passage of the main heat exchanger. A reflux compressor configured to receive and compress fluid from the withdrawn vapor warming passage of the main heat exchanger. A reflux aftercooler is configured to receive and cool fluid from the reflux compressor and direct cooled fluid to the main reflux stream cooling passage of the main heat exchanger. A reflux separation device is configured to receive fluid from the main reflux stream cooling passage of the main heat exchanger, with the reflux separation device having a vapor outlet and a liquid outlet, wherein the vapor outlet of the reflux separation device is configured to direct fluid to the reflux vapor cooling passage of the main heat exchanger and the liquid outlet of the reflux separation device is configured to direct fluid to the second reflux inlet port of the distillation column.

In another aspect, a system for removing nitrogen from a natural gas fluid feed stream includes a main heat exchanger including a main feed cooling passage, a withdrawn vapor warming passage, main reflux stream cooling passage, a reflux vapor cooling passage and a vapor return stream passage with the main feed cooling passage including an inlet and an outlet, where the inlet of the main feed cooling passage is configured to receive the natural gas fluid feed stream. A distillation column includes a feed inlet, a return vapor outlet, a side vapor outlet port, first and second reflux inlet ports and a bottoms liquid outlet, wherein the side vapor outlet port and the first and second reflux inlet ports are positioned between the feed inlet and the return vapor outlet. The feed inlet of the distillation column is configured to receive a fluid stream from the outlet of the main feed cooling passage of the main heat exchanger. The side vapor outlet port of the distillation column is configured to provide vapor to the withdrawn vapor warming passage of the main heat exchanger. The return vapor outlet of the distillation column is configured to provide nitrogen vapor to said nitrogen vapor return passage of the main heat exchanger. The first reflux inlet port of the distillation column is in fluid communication with the reflux vapor cooling passage of the main heat exchanger. A reflux compressor configured to receive and compress fluid from the withdrawn vapor warming passage of the main heat exchanger. A reflux aftercooler is configured to receive and cool fluid from the reflux compressor and direct cooled fluid to the main reflux stream cooling passage of the main heat exchanger. A reflux separation device is configured to receive fluid from the main reflux stream cooling passage of the main heat exchanger, with the reflux separation device having a vapor outlet and a liquid outlet, wherein the vapor outlet of the reflux separation device is configured to direct fluid to the reflux vapor cooling passage of the main heat exchanger and the liquid outlet of the reflux separation device is configured to direct fluid to the second reflux inlet port of the distillation column. The nitrogen vapor return passage and the withdrawn vapor warming passage of the main heat exchanger are configured to cool the main feed cooling passage, the main reflux stream cooling passage and the reflux vapor cooling passage of the main heat exchanger.

In still another aspect, a method of removing nitrogen from a natural gas fluid teed stream includes the steps of cooling the natural gas fluid feed stream in a main heat exchanger; directing the cooled natural gas fluid teed stream to a distillation column; withdrawing vapor from a side of the distillation column; warming the withdrawn vapor using the main heat exchanger so that refrigeration is provided in the main heat exchanger; compressing the warmed withdrawn vapor; cooling and partially condensing the compressed withdrawn vapor to form a first mixed phase reflux stream; separating the first mixed phase reflux stream into a first liquid reflux stream and a first vapor reflux stream; directing the first liquid reflux stream to the distillation column; cooling the first vapor reflux stream so that a second reflux stream is formed; directing the second reflux stream to the distillation column; directing a nitrogen vapor return stream from the distillation column to the main heat exchanger; warming the nitrogen vapor return stream using the main heat exchanger so that refrigeration is provided in the main heat exchanger; and withdrawing liquid from a bottom of the distillation column.

DETAILED DESCRIPTION OF EMBODIMENTS

Disclosed herein is a nitrogen rejection unit (NRU) system and method for the removal of nitrogen from a natural gas stream with a heat pump system and method to provide additional refrigeration. Embodiments of the system and method of the disclosure are illustrated in FIGS. 1-5 and described below.

It should be noted herein that the passages and streams are sometimes both referred to by the same element number set out in the figures. Also, as used herein, and as known in the art, a heat exchanger is that device or an area in the device wherein indirect heat exchange occurs between two or more streams at different temperatures, or between a stream and the environment. As used herein, the terms "communication", "communicating", and the like generally refer to fluid communication unless otherwise specified. Furthermore, although two fluids in communication may exchange heat upon mixing, such an exchange would not be considered to be the same as heat exchange in a heat exchanger, although such an exchange can take place in a heat exchanger. As used herein, the term "reducing the pressure of" (or variations thereof) does not involve a phase change, while the term "flashing" (or variations thereof) involves a phase change, including even a partial phase change. As used herein, the terms, "high", "middle", "mid", "warm" and the like are relative to comparable streams, as is customary in the art.

Figure 1:
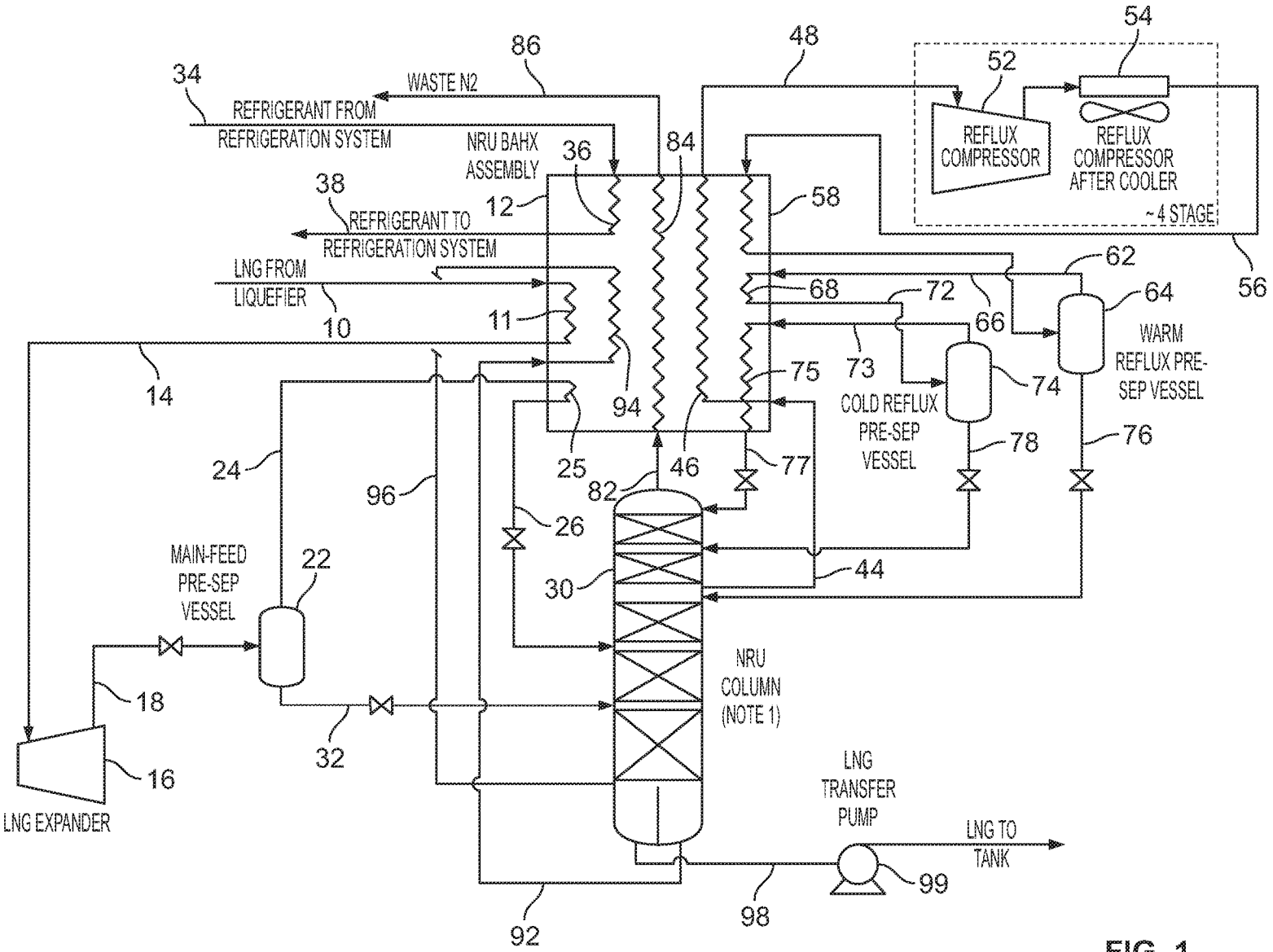
FIG. 1 is a process flow and schematic illustrating a first embodiment of the system and method of the disclosure.

A first embodiment of the system and method of the disclosure, illustrated in FIG. 1, receives a liquid natural gas feed (LNG) feed and features refrigeration recovery for the main refrigeration system, an LNG expander, a main feed pre-separation vessel, three levels of reflux (with two pre-separation or pre-sep vessels), and thermosiphon-type reboiler circulation. More specifically, with reference to FIG. 1, a feed of liquid natural gas 10 is received by a main feed cooling passage 11 in main heat exchanger 12 and is cooled therein. As an example only, the heat exchanger 12 (and all main heat exchangers in the further embodiments discussed below) may be a brazed aluminum heat exchanger (BAHX) or other heat exchanger type. The resulting cold stream 14 is then let down in pressure and partially vaporized by a liquid expander 16 and the resulting stream 18 is fed to a main feed separation device, such as separation vessel 22. It should be noted that a JT valve, or some other expansion device or arrangement known in the art may be used in place of the liquid expander 16.

The vapor stream 24 exiting the separation vessel 22 is cooled in feed vapor portion cooling passage 25 in the heat exchanger 12 with the resulting cooled stream 26 being directed to a first feed inlet of a nitrogen rejection unit (NRU) distillation column 30. The liquid stream 32 exiting the separation vessel 22 also travels so the NRU column 30 where it enters at a second feed inlet located below the first feed inlet of stream 26.

In alternative embodiments, the cooled feed stream 14 feed may enter the NRU column 30 through a single feed inlet, or it may be pre-separated in more than one separation device (as opposed to the single separation device illustrated in FIG. 1) to provide feeds to additional multiple feed inlets in NRU column 30 in order to increase system efficiency (by introducing components with lower boiling points further up the NRU column).

Because the embodiment of FIG. 1 receives a feed stream 10 that is already condensed (LNG), there is excess refrigeration at the warm end of the main heat exchanger 12 which may be recovered and used to provide additional refrigeration to the liquefaction system. More specifically, as illustrated in FIG. 1, the heat exchanger 12 receives a refrigerant inlet stream 34 from the liquefier system. Stream 34 is directed into a refrigerant cooling passage 36 within the heat exchanger 12, wherein the refrigerant from stream 34 is cooled so that cooled refrigerant return stream 38 is produced. Cooled refrigerant stream 38 is directed back to the liquefier.

At some point in the NRU column 30 above the column inlets for main feeds (streams 26 and 32 in FIG. 1), a portion of the vapor flow 44 is withdrawn from a side vapor outlet port of the NRU column 30. This stream is a mixture of components in the column, principally consisting of nitrogen, methane, and any trace low-boiling components (helium, argon, hydrogen, etc.). Stream 44 is directed to a withdrawn vapor warming passage 46 of heat exchanger 12 where it is warmed while providing refrigeration to main teed cooling passage 11 and feed vapor portion cooling passage 25 of the heat exchanger 12, as well as to additional heat exchanger passages wherein streams are cooled presented below.

Warmed stream 48 exits passage 46 of the heat exchanger and is recompressed within reflux compressor 52. The resulting compressed stream travels to reflux aftercooler cooling device 54 where it is cooled against air or by using some other utility cooling system (cooling water, propane, etc.). The cooled stream 56 is sent to the main reflux stream cooling passage 58 of heat exchanger 12 where it is cooled and partially condensed. Stream 62 then travels to a warm reflux separation device, such as vessel 64. The resulting vapor stream 66 travels to warm reflux vapor cooling passage 68 in heat exchanger 12, where it is cooled and partially condensed. The resulting stream 72 then travels to a cold reflux separation device, such as vessel 74. Vapor stream 73 from the cold reflux separation device 74 travels through the cold reflux vapor cooling passage 75 where it is cooled and condensed. The resulting liquid stream 77 travels to a reflux inlet port of the NRU column 30 as reflux, Liquid streams 76 and 78, from warm and cold reflux separation devices 64 and 74, respectively, are directed to reflux inlet ports of the NRU column 30 as reflux. As illustrated in FIG. 1, streams 76, 77 and 78 enter the NRU column 30 at multiple inlet points. As a result, in summary, the main reflux stream 56 is partially condensed at multiple temperatures and fed into the NRU column 30 at multiple points.

A nitrogen return vapor stream 82 exits a return vapor outlet in the top portion of the NRU column 30 and is sent to the nitrogen vapor return passage 84 in heat exchanger 12 to provide refrigeration to the heat exchanger passages described above wherein streams are cooled. The resulting warmed nitrogen stream 86 is vented to atmosphere or used for other purposes (such as fuel).

In view of the above, the side vapor outlet port for stream 44 and the reflux inlet ports for streams 76, 77 and 78 of the NRU column 30 are positioned between the feed inlets for streams 26 and 32 and the return vapor outlet for stream 82.

An optional column reboiler system provides refrigeration to other streams, and consists of one or more individual reboiler services. It may be of forced recirculation type (with circulation provided by pumps), thermosiphon type (with circulation provided hydraulically, with the NRU column installed above the portion of the BAHX assembly containing the reboiler service(s)), or by some other method. In the embodiment illustrated in FIG. 1, a thermosiphon reboiler service is provided and includes a liquid line 92 through which a liquid stream exits the bottom of the NRU column 30 and travels to a reboiler passage 94 in the heat exchanger 12. The liquid entering the reboiler passage is warmed and at least partially vaporized as refrigeration is provided within the heat exchanger 12. The resulting reboiler return stream 96 exits the heat exchanger and is returned to the NRU column 30 via a reboiler inlet port.

The bottoms liquid stream 98 from the NRU column may be pumped via pump 99, or otherwise directed, to other systems or pumped back to the heat exchanger 12 and used to provide condensing duty for the main LNG feed.

In alternative embodiments of the system, the liquids from any of the pre-sep vessels (such as 22, 64 and/or 74 of FIG. 1) may be subcooled further, which can increase efficiency. The liquids from any of the pre-sep vessels or from the coldest reflux service may be recycled fully or partially to the reflux compressor suction in order to provide additional refrigeration to the system in order to improve system efficiency or operability.

Figure 2:
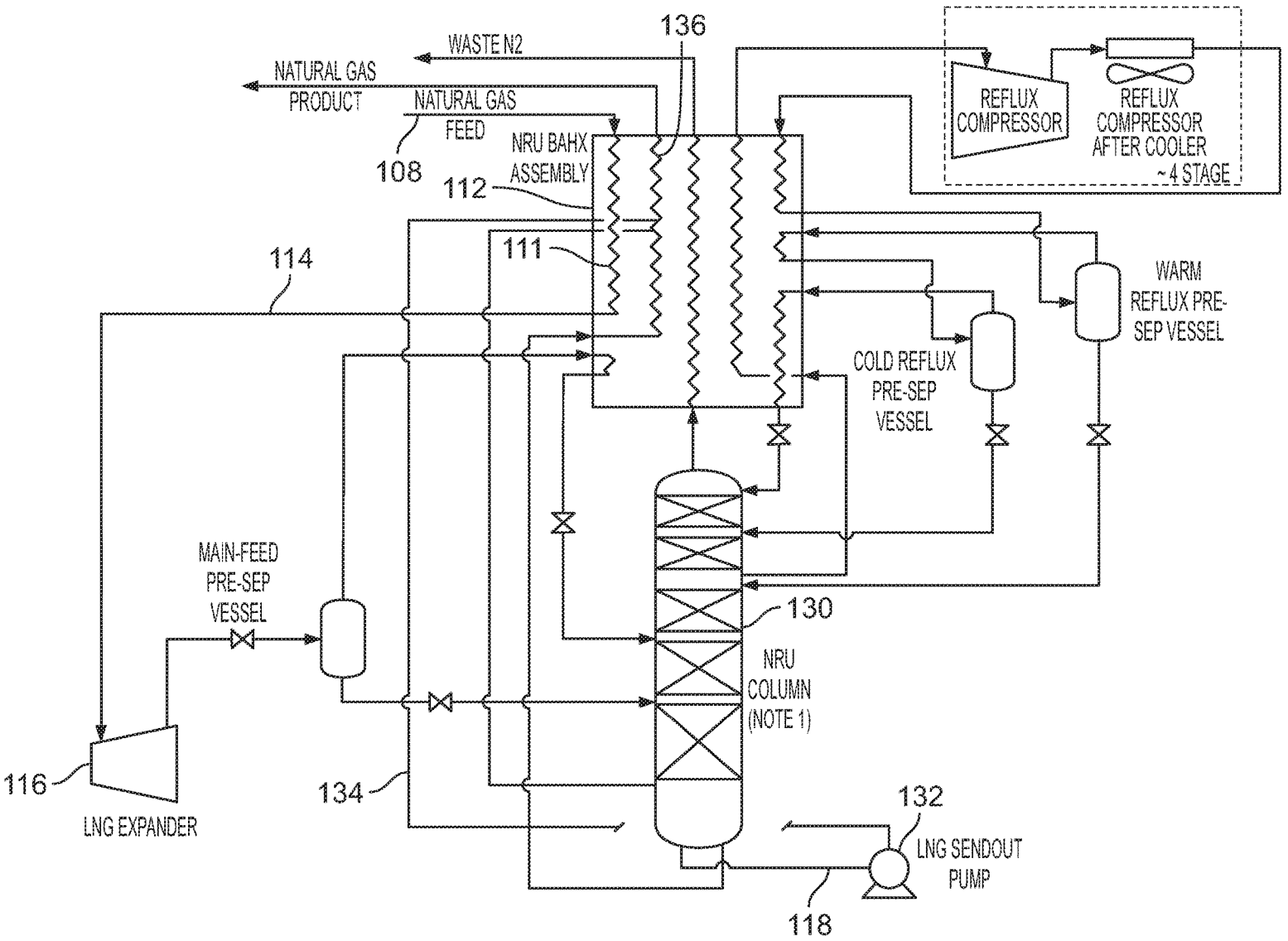
FIG. 2 is a process flow and schematic illustrating a second embodiment of the system and method of the disclosure.

In an alternative embodiment of the system and method of the disclosure, illustrated in FIG. 2, the system receives a warm natural gas feed and features an LNG expander, a main feed pre-separation vessel, three levels of reflux (with two pre-separation vessels), and thermosiphon-type reboiler circulation. More specifically, with reference to FIG. 2, a warm natural gas feed stream 108 is cooled and at least partially condensed in the main feed cooling passage 111 of main heat exchanger 112. The resulting stream 114 is then let down in pressure and partially vaporized by a liquid expander 116.

The remaining components of the embodiment of FIG. 2 operate in the same manner as described above for FIG. 1, with the exception of processing of the bottoms liquid stream 118 from NRU column 130. More specifically, in the embodiment of FIG. 2, the bottoms liquid stream 118 is pumped back via pump 132 as liquid stream 134 to the heat exchanger 112 where it enters bottoms liquid warming passage 136 for use in providing refrigeration or condensing duty for the main natural gas feed 108.

In embodiments where product LNG is pumped and reboiled to provide refrigeration for the main feed, a set of pumps with high discharge pressure can send a portion to a higher pressure passage in the main heat exchanger and a valve may be used to send another portion of the flow to a lower pressure passage in the main heat exchanger. In other words, a single pump can be used to supply two pressure levels of refrigeration to reduce the natural gas recompression requirements.

Figure 3:
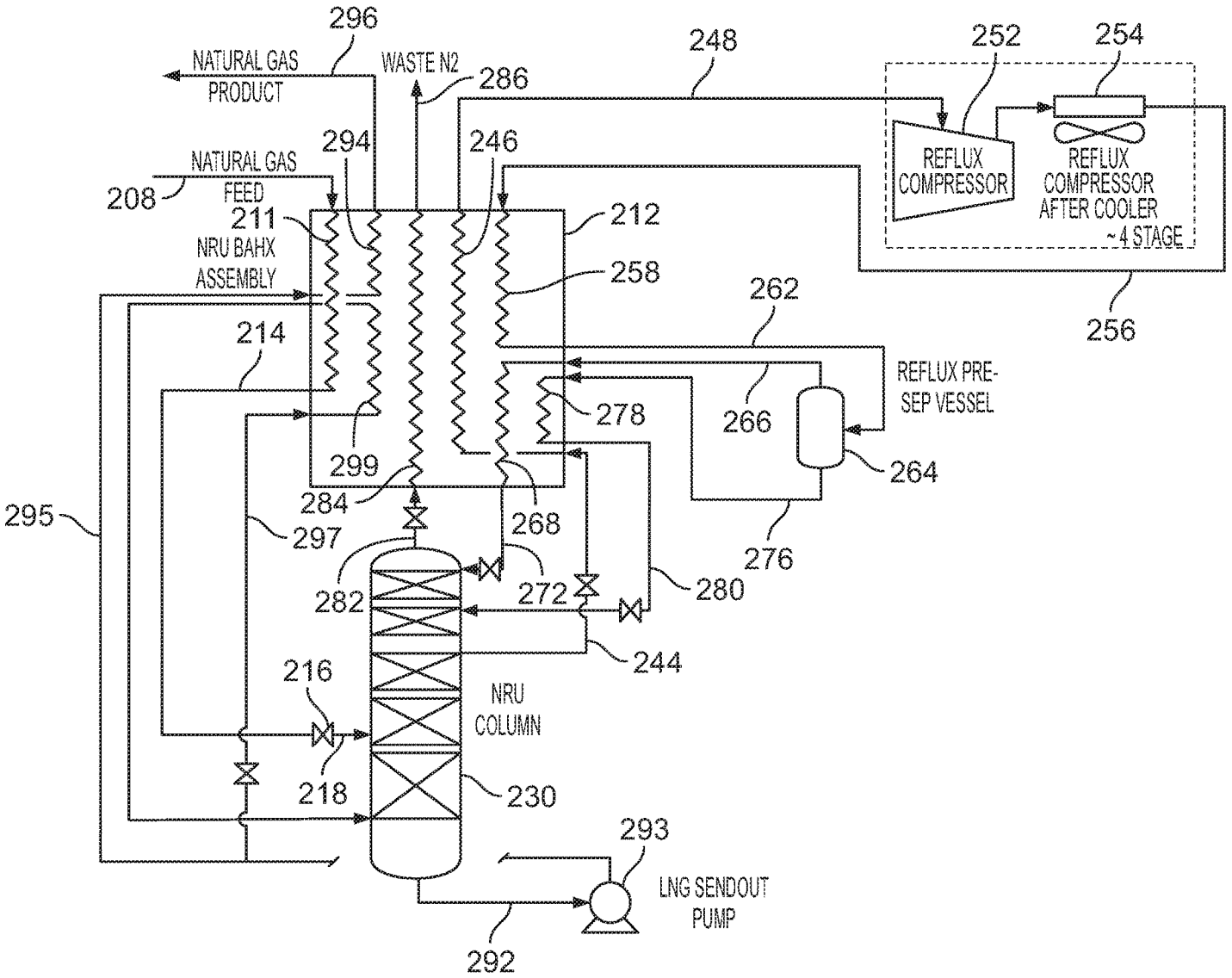
FIG. 3 is a is a process flow and schematic illustrating a third embodiment of the system and method of the disclosure.

In an alternative embodiment of the system and method of the disclosure, illustrated in FIG. 3, the system receives a warm natural gas feed and features a forced-circulation reboiler, and two levels of reflux (with one pre-separation vessel). More specifically, with reference to FIG. 3, a warm natural gas feed stream 208 is cooled and at least partially condensed in the main feed cooling passage 211 of main heat exchanger 212. The resulting stream 214 is then let down in pressure and partially vaporized by a JT valve 216. The resulting stream 218 is fed to NRU column 230. Alternative expansion devices known in the art may be used in place of JT valve 216.

At some point in the column above the column inlet for main feed stream 218, a portion of the vapor flow 244 is withdrawn from a side outlet port of the NRU column 230. This stream is a mixture of components in the column, principally consisting of nitrogen, methane, and any trace low-boiling components (helium, argon, hydrogen, etc.). Stream 244 is directed to a withdrawn vapor warming passage 246 of heat exchanger 212 where it is warmed while providing refrigeration to main feed cooling passage 211 of the heat exchanger 212, as well as to additional heat exchanger passages wherein streams are cooled presented below.

Warmed stream 248 exits passage 246 of the heat exchanger and is recompressed within reflux compressor 252. The resulting compressed stream travels to reflux aftercooler cooling device 254 where it is cooled against air or by using some other utility cooling system (cooling water, propane, etc.). The cooled stream 256 is sent to the main reflux stream cooling passage 258 of heat exchanger 212 where it is cooled and partially condensed. Stream 262 then travels to a reflux separation device, such as vessel 264. The resulting vapor stream 266 travels to reflux vapor cooling passage 268 in heat exchanger 212, where it is cooled and condensed. The resulting liquid stream 272 travels to NRU column 230 as reflux. Liquid stream 276 from separation device 264 is directed to a reflux liquid cooling passage 278 of heat exchanger 212 where it is subcooled. The resulting stream 280 is directed to the NRU column 230 as reflux. As illustrated in FIG. 3, streams 272 and 280 enter the NRU column 230 via multiple reflux inlet ports.

A nitrogen vapor stream 282 exits the top of the NRU column 230 and is sent to the nitrogen vapor return passage 284 in heat exchanger 212 to provide refrigeration to the heat exchanger passages described above wherein streams are cooled. The resulting warmed nitrogen stream 286 is vented to atmosphere or used for other purposes (such as fuel).

The bottoms liquid stream 292 from column 230 is pumped via pump 293 as liquid stream 295 to the heat exchanger 212 where it enters bottoms liquid warming passage 294 for use in providing refrigeration or condensing duty for the main natural gas feed 208. A resulting natural gas stream 296 exits passage 294. A portion of liquid stream 295 may be directed as stream 297 to reboiler passage 299 of the main heat exchanger 212 with the resulting at least partially vaporized stream returned to the column 230 as a reboiler service to provide extra refrigeration within the heat exchanger.

Figure 4:
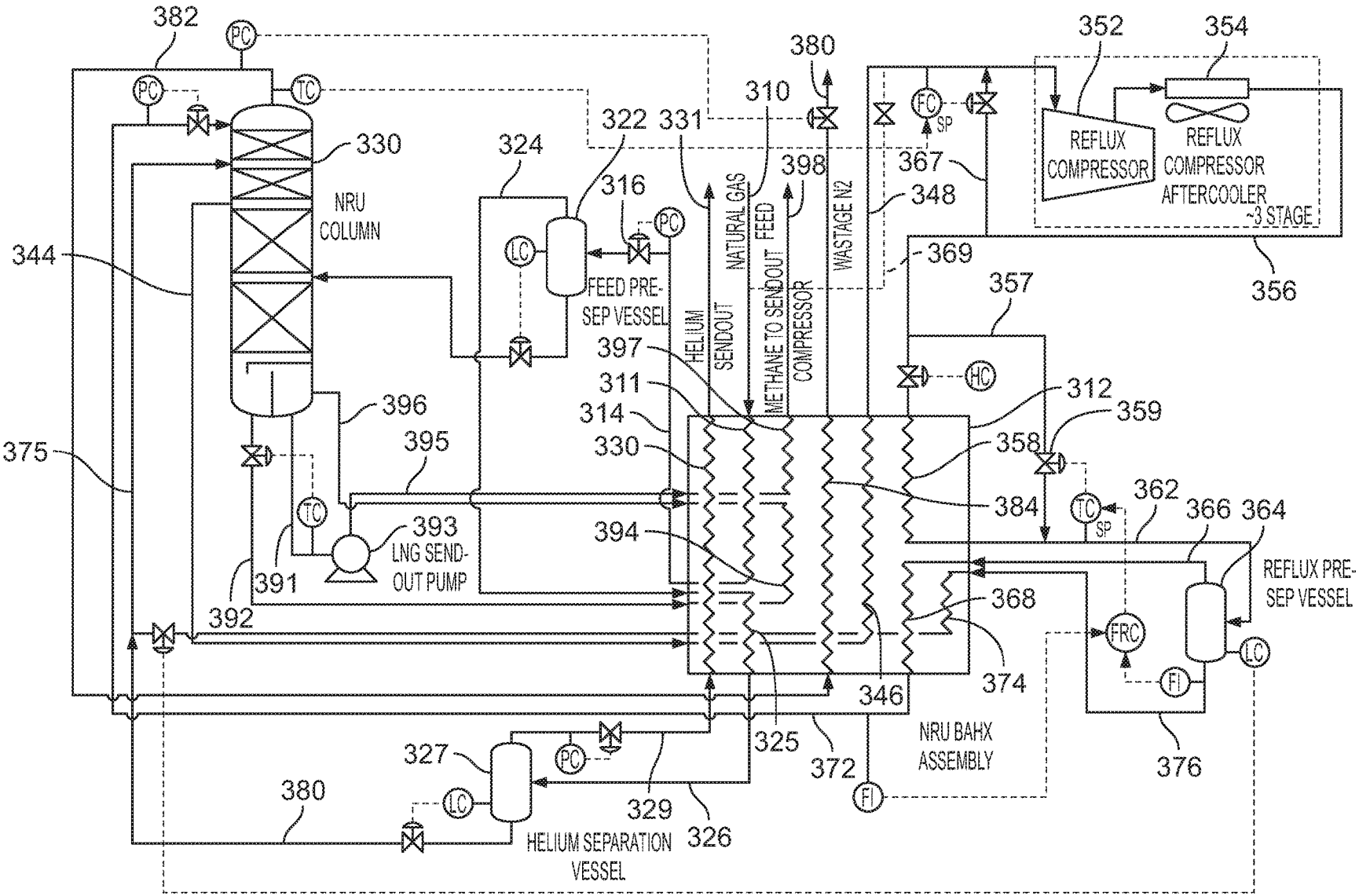
FIG. 4 is a process flow and schematic illustrating a fourth embodiment of the system and method of the disclosure.

In another alternative embodiment of the system and method of the disclosure, illustrated in FIG. 4, the system receives a warm natural gas feed and features a thermosiphon recirculation reboiler, two levels of reflux, and feed gas-based helium recovery. Helium recovery is performed by use of a feed separation vessel, with the liquids sent to the column and the vapor returned to the exchanger assembly and cooled further. After cooling, the feed separation vessel overheads are sent to a low-pressure separator, with the overhead forming the helium product, and the liquids sent near to the top of the column.

More specifically, with reference to FIG. 4, a feed of natural gas 310 is received by a main feed cooling passage 311 in main heat exchanger 312 and is at least partially condensed therein. The resulting cold stream 314 is then let down in pressure and partially vaporized by a JT valve 316. The resulting stream 318 is fed to a main feed separation device, such as separation vessel 322. It should be noted that some other expansion device or arrangement known in the art may be used in place of the JT valve 316.

The liquid stream 332 exiting the separation vessel 322 travels to the main feed inlet of the NRU column 330.

The vapor stream 324 exiting the separation vessel 322 is cooled in feed vapor portion cooling passage 325 in the heat exchanger 312 with the resulting cooled stream 326 being directed a helium separation device, such as helium separation vessel 327. The helium vapor stream 329 exiting the helium separation vessel 327 travels through helium refrigeration recovery passage 330 whereby refrigeration is provided in the heat exchanger 312. A warmed helium vapor sendout stream 331 exits passage 330 of the heat exchanger 312.

At some point in the column above the column inlet for main feed stream 332, a portion of the vapor flow 344 is withdrawn from a side outlet port of the NRU column 330. This stream is a mixture of components in the column, principally consisting of nitrogen, methane, and any trace low-boiling components (helium, argon, hydrogen, etc.). Stream 344 is directed to a withdrawn vapor warming passage 346 of heat exchanger 312 where it is warmed while providing refrigeration within the heat exchanger 312.

Warmed stream 348 exits passage 346 of the heat exchanger and is recompressed within reflux compressor 352. The resulting compressed stream travels to reflux aftercooler cooling device 354 where it is cooled against air or by using some other utility cooling system (cooling water, propane, etc.). The cooled stream 356 is sent to the main reflux stream cooling passage 358 of heat exchanger 312 where it is cooled and partially condensed. Stream 362 then travels to a reflux separation device, such as vessel 364. The resulting vapor stream 366 travels to reflux vapor cooling passage 368 in heat exchanger 312, where it is cooled and condensed. The resulting stream 372 travels to the NRU column 330 as reflux.

A recycle line 367 including a corresponding valve may be provided to control the composition of the stream entering the reflux compressor 352.

In order to increase operability, the reflux compressor suction may optionally be blended with feed gas via line 369 (illustrated in phantom in FIG. 4) by adjustment of a corresponding valve in order to maintain a more consistent or more favorable reflux compressor suction composition.

A temperature control bypass line 357 features a valve 359 that may be used to adjust the portion of stream 356 that passes through the passage 358 so as to control the temperature within the reflux separation vessel 364.

Liquid stream 376 from reflux separation device 364 is directed to the reflux liquid passage 374 of the column where it is subcooled and then directed to the NRU column for reflux as stream 375.

The liquid stream 380 exiting the bottom of helium separation vessel 327 joins reflux stream 375 and is directed to column 330.

As illustrated in FIG. 4, streams 372 and 375 enter the NRU column 330 via multiple reflux inlet ports.

A nitrogen vapor stream 382 exits the top of the NRU column 330 and is sent to the nitrogen vapor return stream passage 384 in heat exchanger 312 to provide refrigeration to the heat exchanger passages in the heat exchanger wherein streams are cooled. The resulting warmed nitrogen stream 386 is vented to atmosphere or used for other purposes (such as fuel).

In the embodiment illustrated in FIG. 4, a thermosiphon reboiler service is provided and includes a liquid line 392 through which a liquid stream exits the bottom of the NRU column 330 and travels to a reboiler passage 394 in the heat exchanger 312. The liquid entering the reboiler passage is warmed and at least partially vaporized as refrigeration is provided within the heat exchanger 312. The resulting reboiler return stream 396 exits the heat exchanger and is returned to the NRU column 330.

The bottoms liquid stream 391 from column 330 is pumped via pump 393 as liquid stream 395 to the heat exchanger 312 where it enters bottoms liquid warming passage 397 for use in providing refrigeration or condensing duty for the main natural gas feed 310. The resulting methane vapor stream 398 may be directed to a sendout compressor.

Figure 5:
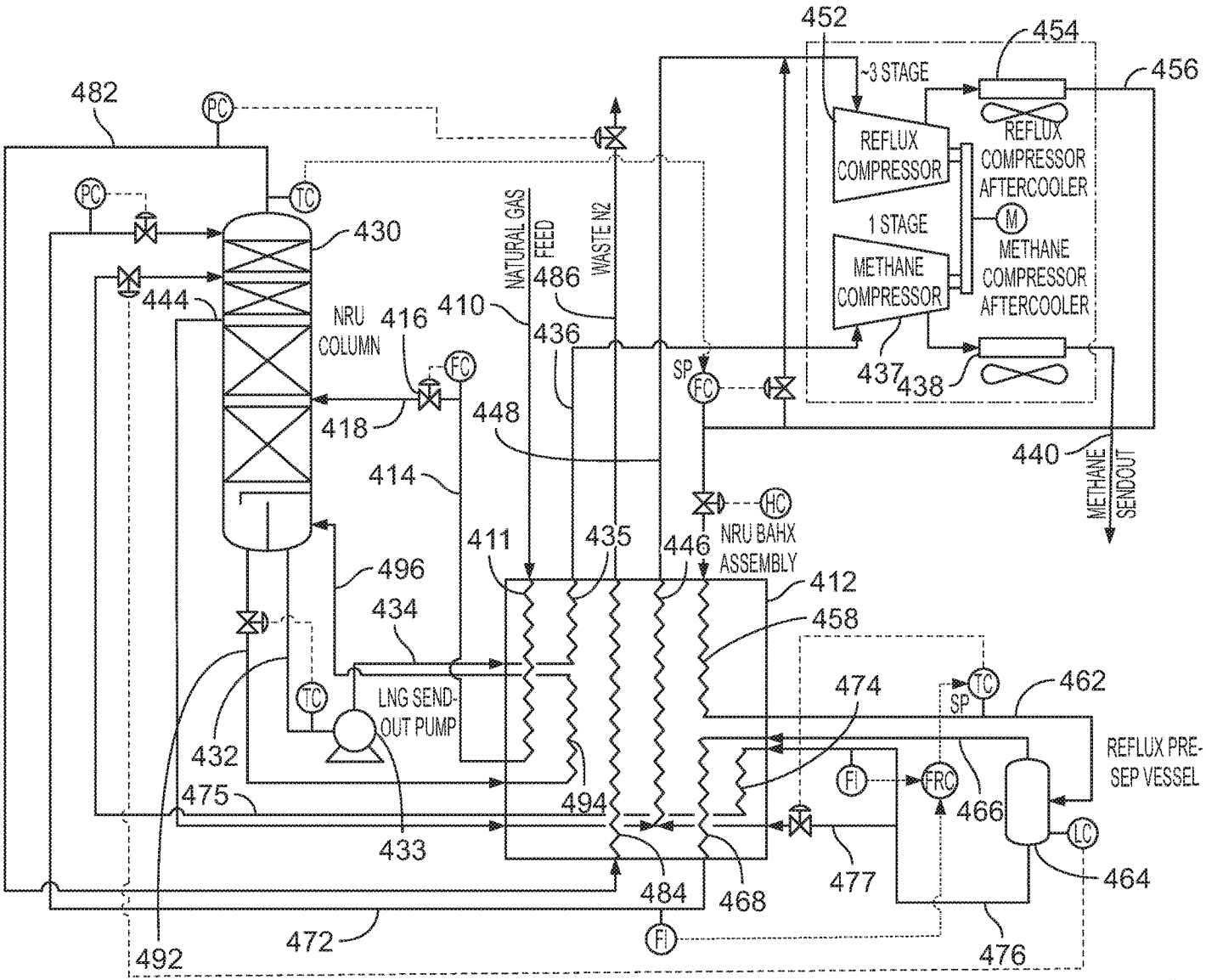
FIG. 5 is a process and flow schematic illustrating a fifth embodiment of the system and method of the disclosure.

In another alternative embodiment of the system and method of the disclosure, illustrated in FIG. 5, the system receives a warm natural gas feed and features a thermosiphon recirculation reboiler, two levels of reflux, and refrigeration via partial recycle of the liquids from the reflux pre-separation vessel.

More specifically, with reference to FIG. 5, a feed of natural gas 410 is received by a main feed cooling passage 411 in main heat exchanger 412 and is at least partially condensed therein. The resulting cold stream 414 is then let down in pressure and partially vaporized by a JT valve 416. The resulting stream 418 is fed into main feed inlet of the NRU column 430.

At some point in the column above the column inlet for main feed stream 418, a portion of the vapor flow 444 is withdrawn from a side outlet port of the NRU column 430. This stream is a mixture of components in the column, principally consisting of nitrogen, methane, and any trace low-boiling components (helium, argon, hydrogen, etc.). Stream 444 is directed to a withdrawn vapor warming passage 446 of heat exchanger 412 where it is warmed while providing refrigeration within the heat exchanger 412.

Warmed stream 448 exits passage 446 of the heat exchanger and is recompressed within reflux compressor 452. The resulting compressed stream travels to reflux aftercooler cooling device 454 where it is cooled against air or by using some other utility cooling system (cooling water, propane, etc.). The cooled stream 456 is sent to the main reflux stream cooling passage 458 of heat exchanger 412 where it is cooled and partially condensed. Stream 462 then travels to a reflux separation device, such as vessel 464. The resulting vapor stream 466 travels to reflux vapor cooling passage 468 in heat exchanger 412, where it is cooled and condensed. The resulting stream 472 travels to the NRU column 430 as reflux.

Liquid stream 476 from reflux separation device 464 is directed to the reflux liquid passage 474 of the column where it is subcooled and then directed to the NRU column for reflux as stream 475. Streams 472 and 475 enter the NRU column 430 via multiple reflux inlet ports.

As illustrated in FIG. 5, the liquid from any pre-sep vessel, such as reflux pre-sep vessel 464, or from the coldest reflux service, may be recycled full or partially via reflux recycle line 477, and adjustment of the corresponding reflux recycle valve, to heat exchanger passage 446 (so that passage 446 also serves as a reflux recycle passage) and the reflux compressor suction in order to provide additional refrigeration in the heat exchanger 412 in order to improve system efficiency or operability. In an alternative embodiment, the stream in line 477 may be directed to a separate, dedicated reflux recycle passage in the main heat exchanger that runs parallel to heat exchanger passage 446, with the outlet in fluid communication with the reflux compressor suction.

A nitrogen vapor stream 482 exits the top of the NRU column 430 and is sent to the nitrogen vapor return passage 484 in heat exchanger 412 to provide refrigeration to the heat exchanger passages in the heat exchanger wherein streams are cooled. The resulting warmed nitrogen stream 486 is vented to atmosphere or used for other purposes (such as fuel).

The bottoms liquid stream 432 from NRU column 430 is pumped via pump 433 as liquid stream 434 to the heat exchanger 412 where it enters bottoms liquid warming passage 435 for use in providing refrigeration or condensing duty for the main natural gas feed 410. The resulting methane vapor stream 436 is directed to a compressor, such as methane compressor 437. The resulting stream is directed to aftercooler cooling device 438 where it is cooled against air or by using some other utility cooling system (cooling water, propane, etc.) so as to produce methane sendout stream 440.

In the embodiment illustrated in FIG. 5, a thermosiphon reboiler service is provided and includes a liquid line 492 through which a liquid stream exits the bottom of the NRU column 430 and travels to a reboiler passage 494 in the heat exchanger 412. The liquid entering the reboiler passage is warmed and at least partially vaporized as refrigeration is provided within the heat exchanger 412. The resulting reboiler return stream 496 exits the heat exchanger and is returned to the NRU column 430.

There are several aspects of the present subject matter which may be embodied separately or together in the methods, devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

While the preferred embodiments of the invention have been shown and described, it will be apparent to those skilled in the art that changes and modifications may be made therein without departing from the spirit of the invention, the scope of which is defined by the appended claims.

What is claimed is:

1. A system for removing nitrogen from a natural gas fluid feed stream comprising:

a. a main heat exchanger including a main feed cooling passage, a withdrawn vapor warming passage, a main reflux stream cooling passage, a reflux vapor cooling passage, a vapor portion cooling passage, and a nitrogen vapor return passage, said main feed cooling passage including an inlet and an outlet, where the inlet of the main feed cooling passage is configured to receive the natural gas fluid feed stream;

b. a distillation column including a first feed inlet and a second feed inlet, a return vapor outlet, a side vapor outlet port, first and second reflux inlet ports and a bottoms liquid outlet, wherein said side vapor outlet port and said first and second reflux inlet ports are positioned between the feed inlet and the return vapor outlet;

c. said side vapor outlet port of the distillation column configured to provide vapor to the withdrawn vapor warming passage of the main heat exchanger, said return vapor outlet of the distillation column configured to provide nitrogen vapor to said nitrogen vapor return passage of the main heat exchanger and said first reflux inlet port of the distillation column is in fluid communication with the reflux vapor cooling passage of the main heat exchanger;

d. a reflux compressor configured to receive and compress fluid from the withdrawn vapor warming passage of the main heat exchanger;

e. a reflux aftercooler configured to receive and cool fluid from the reflux compressor and direct cooled fluid to the main reflux stream cooling passage of the main heat exchanger;

f. a reflux separation device configured to receive fluid from the main reflux stream cooling passage of the main heat exchanger, said reflux separation device having a vapor outlet and a liquid outlet, wherein the vapor outlet of the reflux separation device is configured to direct fluid to the reflux vapor cooling passage of the main heat exchanger and the liquid outlet of the reflux separation device is configured to direct fluid to the second reflux inlet port of the distillation column;

g. an expansion device configured to receive and partially condense a cooled natural gas fluid feed stream from the main feed cooling passage of the main heat exchanger;

h. a main feed separation device configured to receive a mixed phase stream from the expansion device, said main feed separation device including a vapor outlet and a liquid outlet, wherein the liquid outlet is configured to direct a liquid stream to the first feed inlet of the distillation column;

i. said vapor portion cooling passage configured to receive and cool a vapor stream from the vapor outlet of the main feed separation device and direct a resulting cooled stream to the second feed inlet of the distillation column.

2. A system for removing nitrogen from a natural gas fluid feed stream comprising:

a. a main heat exchanger including a main feed cooling passage, a withdrawn vapor warming passage, a main reflux stream cooling passage, a warm reflux vapor cooling passage, a cold reflux vapor cooling passage and a nitrogen vapor return passage, said main feed cooling passage including an inlet and an outlet, where the inlet of the main feed cooling passage is configured to receive the natural gas fluid feed stream;

b. a distillation column including a feed inlet, a return vapor outlet, a side vapor outlet port, first, second, and third reflux inlet ports and a bottoms liquid outlet, wherein said side vapor outlet port and said first and second reflux inlet ports are positioned between the feed inlet and the return vapor outlet;

c. said feed inlet of the distillation column configured to receive a fluid stream from the outlet of the main feed cooling passage of the main heat exchanger, said side vapor outlet port of the distillation column configured to provide vapor to the withdrawn vapor warming passage of the main heat exchanger, said return vapor outlet of the distillation column configured to provide nitrogen vapor to said nitrogen vapor return passage of the main heat exchanger and said first reflux inlet port of the distillation column is in fluid communication with the warm reflux vapor cooling passage of the main heat exchanger;

d. a reflux compressor configured to receive and compress fluid from the withdrawn vapor warming passage of the main heat exchanger;

e. a reflux aftercooler configured to receive and cool fluid from the reflux compressor and direct cooled fluid to the main reflux stream cooling passage of the main heat exchanger;

f. a warm reflux separation device configured to receive fluid from the main reflux stream cooling passage of the main heat exchanger, said warm reflux separation device having a vapor outlet and a liquid outlet, wherein the vapor outlet of the warm reflux separation device is configured to direct fluid to the warm reflux vapor cooling passage of the main heat exchanger and the liquid outlet of the warm reflux separation device is configured to direct fluid to the second reflux inlet port of the distillation column;

g. a cold reflux separation device having a vapor outlet and a liquid outlet;

wherein the cold reflux separation device is configured to receive a mixed phase fluid stream from the warm reflux vapor cooling passage of the main heat exchanger, the vapor outlet of the cold reflux separation device is configured to direct a vapor stream to the cold reflux vapor cooling passage, the cold reflux vapor cooling passage is configured to condense a vapor stream and direct a liquid stream to the third reflux inlet port of the distillation column and the liquid outlet of the cold reflux separation device is configured to direct a liquid stream to the first reflux inlet port of the distillation column.

3. The system of claim 1 wherein the distillation column includes a reboiler inlet port and the main heat exchanger includes a reboiler passage configured to receive and at least partially vaporize a liquid stream from the bottoms liquid outlet of the distillation column so that cooling is provided in the main heat exchanger, said reboiler passage also configured to return a fluid stream to the reboiler inlet port of the distillation column.

4. The system of claim 1 wherein the main heat exchanger further includes a bottoms liquid warming passage and further comprising a pump configured to receive a liquid stream from the bottoms liquid outlet of the distillation column and pump the liquid stream to the bottoms liquid warming passage where the liquid stream is warmed to provide cooling in the main heat exchanger.

5. A system for removing nitrogen from a natural gas fluid feed stream comprising:

a. a main heat exchanger including a main feed cooling passage, a withdrawn vapor warming passage, a main reflux stream cooling passage, a reflux vapor cooling passage, a vapor portion cooling passage and a nitrogen vapor return passage, said main feed cooling passage including an inlet and an outlet, where the inlet of the main feed cooling passage is configured to receive the natural gas fluid feed stream;

b. a distillation column including a first feed inlet and a second feed inlet, a return vapor outlet, a side vapor outlet port, first and second reflux inlet ports and a bottoms liquid outlet, wherein said side vapor outlet port and said first and second reflux inlet ports are positioned between the feed inlet and the return vapor outlet;

c. said side vapor outlet port of the distillation column configured to provide vapor to the withdrawn vapor warming passage of the main heat exchanger, said return vapor outlet of the distillation column configured to provide nitrogen vapor to said nitrogen vapor return passage of the main heat exchanger and said first reflux inlet port of the distillation column is in fluid communication with the reflux vapor cooling passage of the main heat exchanger;

d. a reflux compressor configured to receive fluid from the withdrawn vapor warming passage of the main heat exchanger;

e. a reflux aftercooler configured to receive and cool fluid from the reflux compressor and direct cooled fluid to the main reflux stream cooling passage of the main heat exchanger;

f. a reflux separation device configured to receive fluid from the main reflux stream cooling passage of the main heat exchanger, said reflux separation device having a vapor outlet and a liquid outlet, wherein the vapor outlet of the reflux separation device is configured to direct fluid to the reflux vapor cooling passage of the main heat exchanger and the liquid outlet of the reflux separation device is configured to direct fluid to the second reflux inlet port of the distillation column;

g. an expansion device configured to receive and partially condense a cooled natural gas fluid feed stream from the main feed cooling passage of the main heat exchanger;

h. a main feed separation device configured to receive a mixed phase stream from the expansion device, said main feed separation device including a vapor outlet and a liquid outlet, wherein the liquid outlet is configured to direct a liquid stream to the first feed inlet of the distillation column;

i. said vapor portion cooling passage configured to receive and cool a vapor stream from the vapor outlet of the main feed separation device and direct a resulting cooled stream to the second feed inlet of the distillation column;

wherein said nitrogen vapor return passage and said withdrawn vapor warming passage of the main heat exchanger are configured to cool the main feed cooling passage, the main reflux stream cooling passage and the reflux vapor cooling passage of the main heat exchanger.

6. A system for removing nitrogen from a natural gas fluid feed stream comprising:

a. a main heat exchanger including a main feed cooling passage, a withdrawn vapor warming passage, main reflux stream cooling passage, a warm reflux vapor cooling passage, a cold reflux vapor cooling passage and a nitrogen vapor return passage, said main feed cooling passage including an inlet and an outlet, where the inlet of the main feed cooling passage is configured to receive the natural gas fluid feed stream;

b. a distillation column including a feed inlet, a return vapor outlet, a side vapor outlet port, first, second, and third reflux inlet ports and a bottoms liquid outlet, wherein said side vapor outlet port and said first and second reflux inlet ports are positioned between the feed inlet and the return vapor outlet;

c. said feed inlet of the distillation column includes a first feed inlet and a second feed inlet and is configured to receive a fluid stream from the outlet of the main feed cooling passage of the main heat exchanger, said side vapor outlet port of the distillation column configured to provide vapor to the withdrawn vapor warming passage of the main heat exchanger, said return vapor outlet of the distillation column configured to provide nitrogen vapor to said nitrogen vapor return passage of the main heat exchanger and said first reflux inlet port of the distillation column is in fluid communication with the warm reflux vapor cooling passage of the main heat exchanger;

d. a reflux compressor configured to receive fluid from the withdrawn vapor warming passage of the main heat exchanger;

e. a reflux aftercooler configured to receive and cool fluid from the reflux compressor and direct cooled fluid to the main reflux stream cooling passage of the main heat exchanger;

f. a warm reflux separation device configured to receive fluid from the main reflux stream cooling passage of the main heat exchanger, said warm reflux separation device having a vapor outlet and a liquid outlet, wherein the vapor outlet of the warm reflux separation device is configured to direct fluid to the warm reflux vapor cooling passage of the main heat exchanger and the liquid outlet of the warm reflux separation device is configured to direct fluid to the second reflux inlet port of the distillation column;

g. a cold reflux separation device having a vapor outlet and a liquid outlet;

wherein the cold reflux separation device is configured to receive a mixed phase fluid stream from the warm reflux vapor cooling passage of the main heat exchanger, the vapor outlet of the cold reflux separation device is configured to direct a vapor stream to the cold reflux vapor cooling passage, the cold reflux vapor cooling passage is configured to condense a vapor stream and direct a liquid stream to the third reflux inlet port of the distillation column and the liquid outlet of the cold reflux separation device is configured to direct a liquid stream to the first reflux inlet port of the distillation column;

wherein said nitrogen vapor return passage and said withdrawn vapor warming passage of the main heat exchanger are configured to cool the main feed cooling passage, the main reflux stream cooling passage, the warm reflux vapor cooling passage and the cold reflux vapor cooling passage of the main heat exchanger.

7. The system of claim 5 wherein the distillation column includes a reboiler inlet port and the main heat exchanger includes a reboiler passage configured to receive and at least partially vaporize a liquid stream from the bottoms liquid outlet of the distillation column so that cooling is provided in the main heat exchanger, said reboiler passage also configured to return a fluid stream to the reboiler inlet port of the distillation column.

8. The system of claim 5 wherein the main heat exchanger further includes a bottoms liquid warming passage and further comprising a pump configured to receive a liquid stream from the bottoms liquid outlet of the distillation column and pump the liquid stream to the bottoms liquid warming passage where the liquid stream is warmed to provide cooling in the main heat exchanger.

9. A method of removing nitrogen from a natural gas fluid feed stream comprising the steps of:

a. cooling the natural gas fluid feed stream in a main heat exchanger;

b. directing the cooled natural gas fluid feed stream to a distillation column including the steps of: i) separating the cooled natural gas fluid feed stream into a vapor feed stream and a liquid feed stream, and ii) directing the vapor feed stream and the liquid feed stream to the distillation column;

c. withdrawing vapor from a side of the distillation column;

d. warming the withdrawn vapor using the main heat exchanger so that refrigeration is provided in the main heat exchanger;

e. compressing the warmed withdrawn vapor;

f. cooling and partially condensing the compressed withdrawn vapor to form a first mixed phase reflux stream;

g. separating the first mixed phase reflux stream into a first liquid reflux stream and a first vapor reflux stream;

h. directing the first liquid reflux stream to the distillation column;

i. cooling the first vapor reflux stream so that a second reflux stream is formed;

j. directing the second reflux stream to the distillation column;

k. directing a nitrogen vapor return stream from the distillation column to the main heat exchanger;

l. warming the nitrogen vapor return stream using the main heat exchanger so that refrigeration is provided in the main heat exchanger; and m. withdrawing liquid from a bottom of the distillation column.

10. The method of claim 9 wherein step i. includes condensing the first vapor reflux stream so that the second reflux stream is a second liquid reflux stream.

11. A method of removing nitrogen from a natural gas fluid feed stream comprising the steps of:

a. cooling the natural gas fluid feed stream in a main heat exchanger;

b. directing the cooled natural gas fluid feed stream to a distillation column;

c. withdrawing vapor from a side of the distillation column;

d. warming the withdrawn vapor using the main heat exchanger so that refrigeration is provided in the main heat exchanger;

e. compressing the warmed withdrawn vapor;

f. cooling and partially condensing the compressed withdrawn vapor to form a first mixed phase reflux stream;

g. separating the first mixed phase reflux stream into a first liquid reflux stream and a first vapor reflux stream;

h. directing the first liquid reflux stream to the distillation column;

i. cooling and partially condensing the first vapor reflux stream so that a second mixed phase reflux stream is formed;

j. directing the second mixed phase reflux stream to the distillation column, including the steps of:

i) separating the second mixed phase reflux stream to form a second vapor reflux stream and a second liquid reflux stream;

ii) directing the second vapor reflux stream to the main heat exchanger;

iii) condensing the second vapor reflux stream in the main heat exchanger so that a third liquid reflux stream is formed;

iv) directing the second and third liquid reflux streams to the distillation column;

k. directing a nitrogen vapor return stream from the distillation column to the main heat exchanger;

l. warming the nitrogen vapor return stream using the main heat exchanger so that refrigeration is provided in the main heat exchanger; and m. withdrawing liquid from a bottom of the distillation column.

12. The system of claim 2 wherein the distillation column includes a reboiler inlet port and the main heat exchanger includes a reboiler passage configured to receive and at least partially vaporize a liquid stream from the bottoms liquid outlet of the distillation column so that cooling is provided in the main heat exchanger, said reboiler passage also configured to return a fluid stream to the reboiler inlet port of the distillation column.

13. The system of claim 2 wherein the main heat exchanger further includes a bottoms liquid warming passage and further comprising a pump configured to receive a liquid stream from the bottoms liquid outlet of the distillation column and pump the liquid stream to the bottoms liquid warming passage where the liquid stream is warmed to provide cooling in the main heat exchanger.

14. The system of claim 6 wherein the distillation column includes a reboiler inlet port and the main heat exchanger includes a reboiler passage configured to receive and at least partially vaporize a liquid stream from the bottoms liquid outlet of the distillation column so that cooling is provided in the main heat exchanger, said reboiler passage also configured to return a fluid stream to the reboiler inlet port of the distillation column.

15. The system of claim 6 wherein the main heat exchanger further includes a bottoms liquid warming passage and further comprising a pump configured to receive a liquid stream from the bottoms liquid outlet of the distillation column and pump the liquid stream to the bottoms liquid warming passage where the liquid stream is warmed to provide cooling in the main heat exchanger.

* * * * *